US011083304B2

(12) United States Patent
Ji

(10) Patent No.: US 11,083,304 B2
(45) Date of Patent: Aug. 10, 2021

(54) ELECTRIC BED

(71) Applicant: Keeson Technology Corporation Limited, Zhejiang (CN)

(72) Inventor: Chuanxiang Ji, Zhejiang (CN)

(73) Assignee: Keeson Technology Corporation Limited, Jiaxing (CN)

( * ) Notice: Subject to any disclaimer, the term of this patent is extended or adjusted under 35 U.S.C. 154(b) by 230 days.

(21) Appl. No.: 16/288,156

(22) Filed: Feb. 28, 2019

(65) Prior Publication Data

US 2019/0223607 A1 Jul. 25, 2019

Related U.S. Application Data

(63) Continuation of application No. PCT/CN2017/091199, filed on Jun. 30, 2017.

(30) Foreign Application Priority Data

Aug. 31, 2016 (CN) ..... 201610775717.2

(51) Int. Cl.

| | |
|---|---|
| ***A47C 19/02*** | (2006.01) |
| ***A47C 19/12*** | (2006.01) |
| ***A47C 17/86*** | (2006.01) |
| ***A47C 20/04*** | (2006.01) |

(52) U.S. Cl.

CPC ..... *A47C 19/021* (2013.01); *A47C 17/86* (2013.01); *A47C 19/12* (2013.01); *A47C 20/041* (2013.01)

(58) Field of Classification Search

CPC ..... A47C 19/021; A47C 19/12; A47C 17/86; A47C 20/041; A47C 20/04; A47C 19/122; A61G 7/015

USPC ..... 5/131

See application file for complete search history.

(56) References Cited

U.S. PATENT DOCUMENTS

| | | | | | |
|---|---|---|---|---|---|
| 742,266 | A * | 10/1903 | White | A47C 19/021 | 5/306 |
| 774,180 | A * | 11/1904 | Jewell | A47C 19/12 | 5/218 |
| 819,435 | A * | 5/1906 | Jonas | A47C 19/122 | 5/152 |
| 875,184 | A * | 12/1907 | Kilbourne | A47C 19/128 | 5/178 |
| 1,407,234 | A * | 2/1922 | Storey | A47C 19/12 | 5/176.1 |

(Continued)

*Primary Examiner* — Nicholas F Polito
*Assistant Examiner* — Luke Hall

(57) ABSTRACT

An electric bed, includes: a base bed frame; a leg combination bed frame, which is hinged to the base bed frame and is capable of freely pivoting; a leg transmission mechanism supporting beam; a leg transmission mechanism, which includes a first end hinged to the leg combination bed frame, a second end for receiving a driving force so as to enable the leg transmission mechanism to pivot, and a pivoting arm disposed between the first end and the second end and hinged to the leg transmission mechanism supporting beam; and a leg drive motor, one end of the leg drive motor being hinged to the transverse rim near the leg transmission mechanism supporting beam, and the other end of the leg drive motor being hinged to the second end of the leg transmission mechanism, wherein the leg drive motor extends substantially along a straight line when pushing the leg combination bed frame.

9 Claims, 4 Drawing Sheets

(56) References Cited

U.S. PATENT DOCUMENTS 1,436,558 A * 11/1922 Yager ..... A47C 19/12 5/114
2,885,694 A * 5/1959 Ulm ..... A47C 17/86 5/308
3,646,621 A * 3/1972 Fragas ..... A47C 20/04 5/617
5,608,932 A * 3/1997 Hasegawa ..... A47C 20/041 5/600
5,862,551 A * 1/1999 Oguma ..... A61G 7/015 5/618
6,088,853 A * 7/2000 Jansen ..... A47C 20/041 5/616
6,101,647 A * 8/2000 Stroud ..... A47C 20/041 5/613
6,101,649 A * 8/2000 Wu ..... A47C 20/041 5/616
6,276,011 B1 * 8/2001 Antinori ..... A47C 20/041 5/613
6,739,004 B1 * 5/2004 Abrahamsen ..... A47C 20/041 5/610
7,146,662 B1 * 12/2006 Pollard ..... A47B 91/16 5/617
7,240,385 B1 * 7/2007 Brown ..... A47C 20/022 5/617
2008/0262657 A1 * 10/2008 Howell ..... A47C 31/008 700/275
2010/0186168 A1 * 7/2010 Harrison ..... A47C 20/041 5/616
2011/0271446 A1 * 11/2011 Shih ..... A47C 20/041 5/174
2012/0096645 A1 * 4/2012 Shih ..... A61G 7/015 5/614
2013/0038094 A1 * 2/2013 Chen ..... A47C 19/122 297/42
2013/0276234 A1 * 10/2013 Rawls-Meehan ..... A61G 7/015 5/618
2013/0333115 A1 * 12/2013 Reinke ..... A61G 7/002 5/614
2014/0201916 A1 * 7/2014 Ermalovich ..... A61G 7/015 5/618
2014/0250599 A1 * 9/2014 Cassell ..... A61G 7/015 5/613
2015/0107024 A1 * 4/2015 Xu ..... A47C 20/041 5/616
2015/0121623 A1 * 5/2015 Huang ..... A61G 7/018 5/616
2015/0305510 A1 * 10/2015 Tarplee ..... A61G 7/015 601/57
2017/0224559 A1 * 8/2017 Totemeier ..... G06F 21/30
2018/0242751 A1 * 8/2018 MacNaughton ..... A47C 15/008
2018/0360224 A1 * 12/2018 Cimadamore ..... A47C 20/041

* cited by examiner

ELECTRIC BED

CROSS REFERENCE TO RELATED APPLICATIONS

The present application is a Continuation Application of PCT Application No. PCT/CN2017/091199 filed on Jun. 30, 2017, which claims the benefit of Chinese Patent Application No. 201610775717.2 filed on Aug. 31, 2016. All the above are hereby incorporated by reference.

FIELD OF THE TECHNOLOGY

The present application relates to an electric bed.

BACKGROUND OF THE TECHNOLOGY

An electric bed generally includes a bed frame and a rotatable bed plank, and a rotation angle of the bed plank can be adjusted through a drive motor so as to realize a function of changing a posture of a bed body.

The drive motor needs to transmit a driving force to the bed plank through a transmission mechanism. However, an existing transmission mechanism has a relatively complex structure, and when the transmission mechanism is exposed, overall beauty of the electric bed is affected. Therefore, there is a need to hide these mechanical structures under an external bed cover.

However, these complex mechanical structures result in a great overall thickness of the electric bed, and even if these complex structures are hidden under the external bed cover, the electric bed still appears cumbersome.

SUMMARY

It should be noted that the present application aims to overcome one or more defects as described in the background technology.

For the above objective, an electric bed is provided according to the present application, in which a structure of a transmission mechanism is improved and an overall thickness of the electric bed is reduced. The electric bed includes:

a base bed frame, which includes a rectangular frame formed by a pair of longitudinal rims and a pair of transverse rims;

a leg combination bed frame, which is hinged to the base bed frame and is capable of freely pivoting;

a leg transmission mechanism supporting beam connected between the pair of longitudinal rims parallel to the pair of transverse rims;

a leg transmission mechanism, which includes a first end hinged to the leg combination bed frame, a second end for receiving a driving force so as to enable the leg transmission mechanism to pivot, and a pivoting arm disposed between the first end and the second end and hinged to the leg transmission mechanism supporting beam; and a leg drive motor, one end thereof being hinged to the transverse rim near the leg transmission mechanism supporting beam, and the other end thereof being hinged to the second end of the leg transmission mechanism.

By means of the above arrangement, a structure of the leg transmission mechanism is improved, so that the leg drive motor extends substantially along a straight line when pushing the leg combination bed frame. Therefore, the transmission mechanism and the drive motor can be hidden only by arranging an external cover with a small height at a periphery of the electric bed of the present application, making the electric bed look lighter, thinner, and more aesthetically pleasing from outside.

One or more of the following technical features may be further used for the electric bed of the present application.

In an embodiment, the base bed frame further includes a central supporting platform which is fixed on a middle of the base bed frame, and the leg combination bed frame is hinged to the central supporting platform and can pivot relative to the central supporting platform.

In an embodiment, the electric bed further includes:

a head combination bed frame supporting beam connected between the pair of longitudinal rims parallel to the pair of transverse rims and separated from the leg transmission mechanism supporting beam by a distance;

a head combination bed frame, which is hinged to the head combination bed frame supporting beam and is capable of pivoting relative to the head combination bed frame supporting beam;

a head transmission mechanism, which includes a pivoting part hinged to the head combination bed frame supporting beam, a supporting part resting on the head combination bed frame, and a lug for receiving a driving force so as to enable the head transmission mechanism to pivot; and a head drive motor, one end thereof being hinged to the transverse rim near the head combination bed frame, and the other end thereof being hinged to the lug of the head transmission mechanism.

Further, the head combination bed frame is provided thereon with a guide rail for guiding a supporting part of the head transmission mechanism, the supporting part being provided with a wheel and being adapted to move along the guide rail of the head combination bed frame.

Further, the supporting part and the pivoting part of the head transmission mechanism are mounted on two ends of a bent arm in the head transmission mechanism.

Further, the head transmission mechanism includes two bent arms which are respectively rigidly connected to two ends of a main body of the head transmission mechanism.

Further, a plurality of head reinforced supporting elements are disposed between the head combination bed frame supporting beam and the transverse rim near the head combination bed frame supporting beam.

Further, a plurality of leg reinforced supporting elements are disposed between the leg transmission mechanism supporting beam and the transverse rim near the leg transmission mechanism supporting beam.

Further, a vibration absorption supporting element is disposed on the transverse rim near the head combination bed frame in the base bed frame, and when the head combination bed frame is not driven by the head transmission mechanism, the head combination bed frame is supported on the vibration absorption supporting element.

Further, the base bed frame is encased at a periphery thereof by an external cover.

BRIEF DESCRIPTION OF THE DRAWINGS

It shall be appreciated that in the present application, unless apparent contradictions or incompatibility exist, all the features, variations, and/or specific embodiments may be combined with one another in a number of ways.

Other features and advantages of the present application will become self-evident by reading the following specifically described nonrestrictive embodiments in conjunction with the accompanying drawings. In the drawings.

DETAILED DESCRIPTION

It shall be appreciated that the abovementioned drawings are not drawn to actual scale, and they are merely diagrams of a number of preferred features for illustrating principles of the present application. The design features, such as size, directions, orientations, and shapes disclosed in the present application depend on specific applications and service environments.

The present disclosure will be illustrated in detail below in conjunction with the embodiments and the accompanying drawings. In these drawings, same reference numbers indicate same or equivalent components of the present application.

Figure 1:
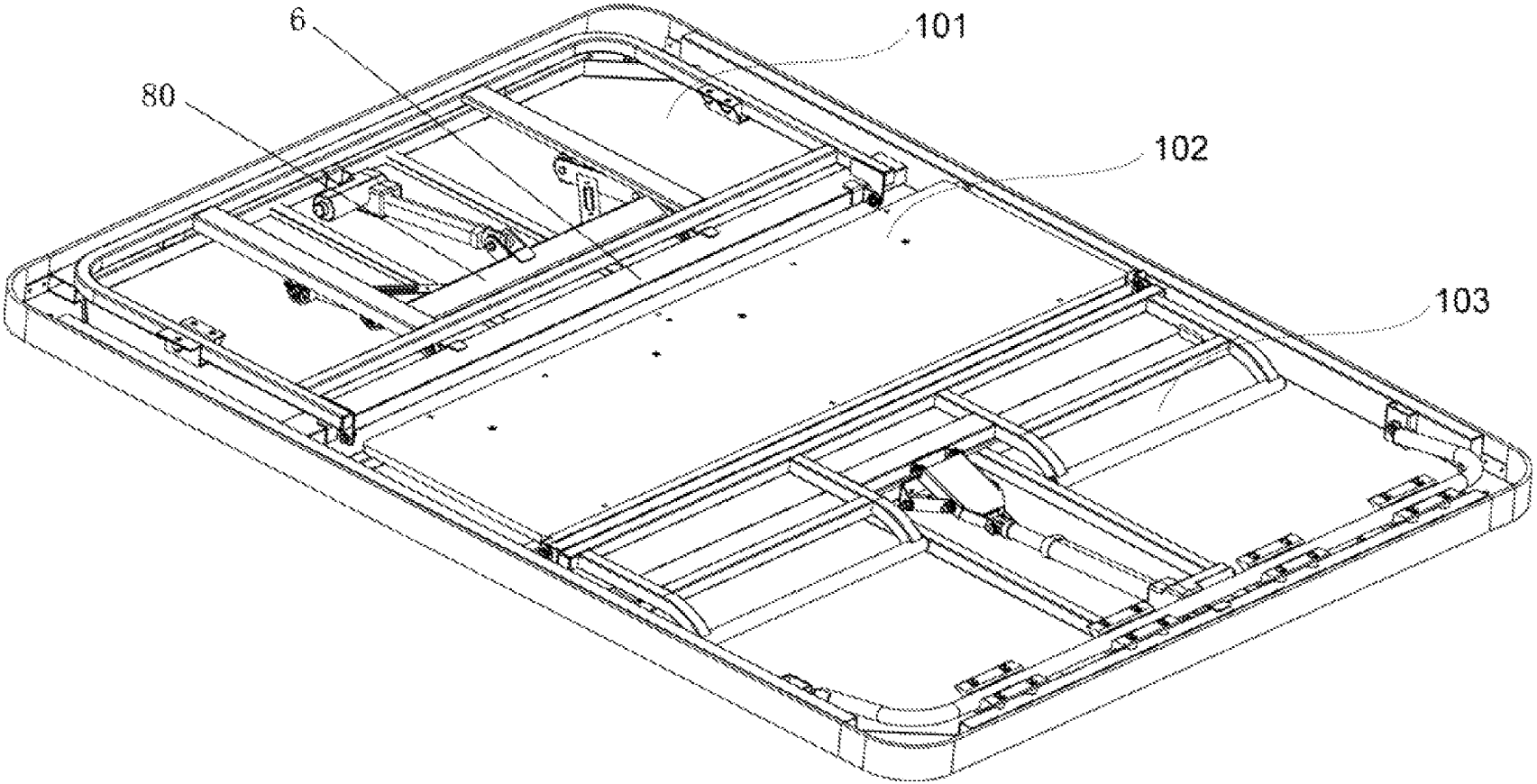
FIG. 1 is a perspective view of an electric bed according to an embodiment of the present application, in which a combination bed frame is not driven by a drive motor.
Figure 2:
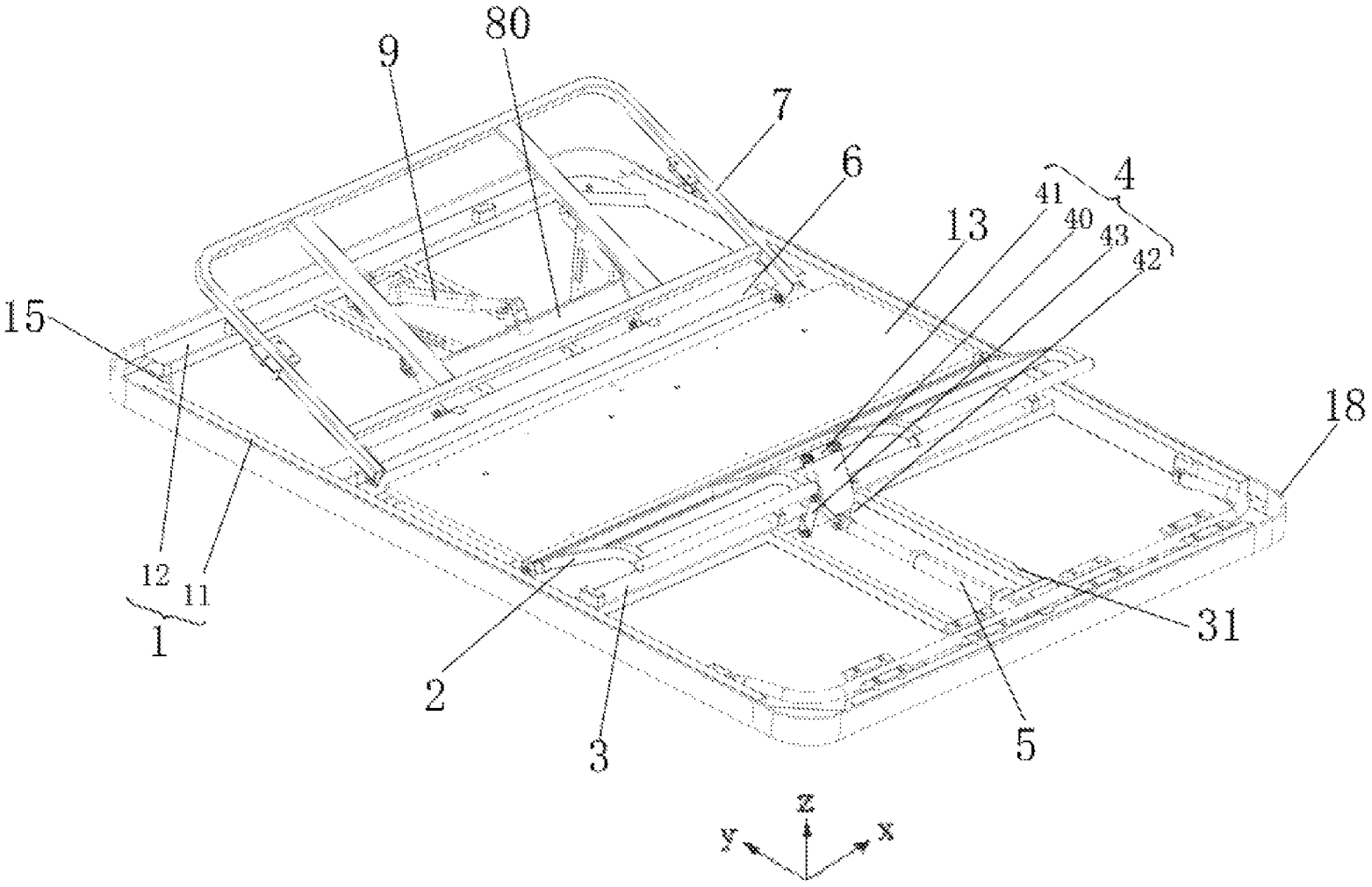
FIG. 2 is another perspective view of the electric bed shown in FIG. 1, in which the combination bed frame is driven to rotate by the drive motor.
Figure 3:
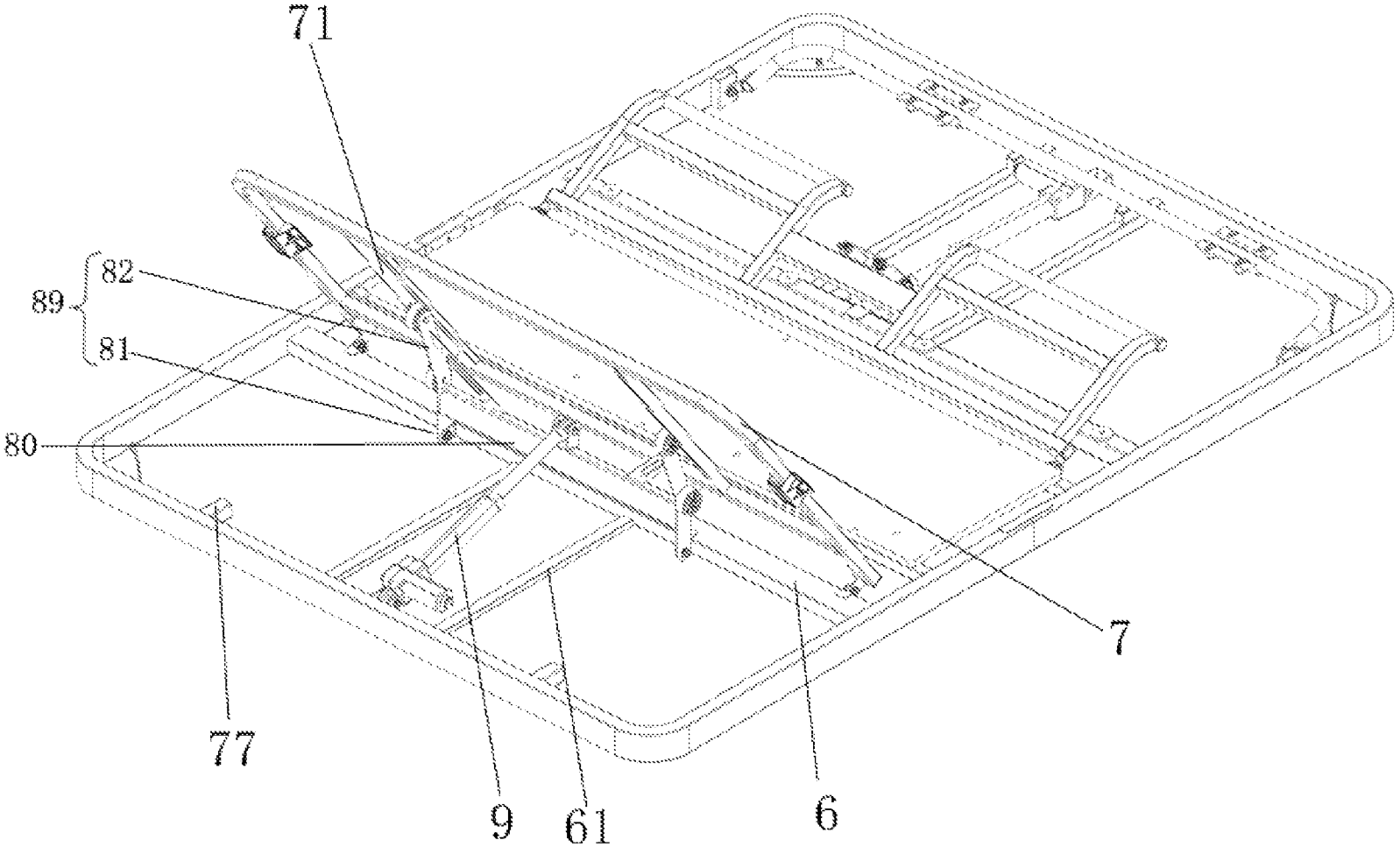
FIG. 3 is a perspective view of the electric bed shown in FIG. 2 in an opposite direction.
Figure 4:
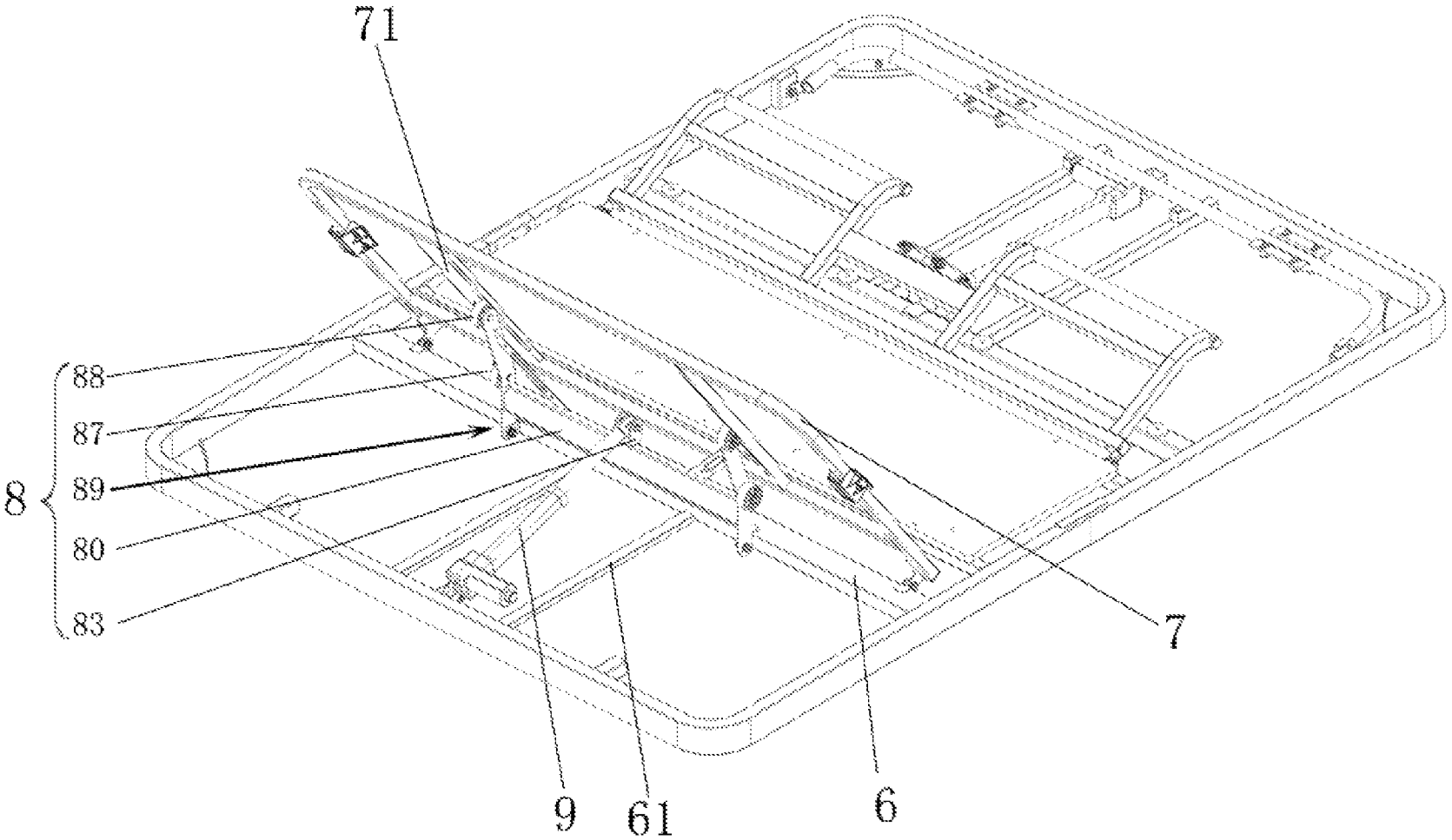
FIG. 4 is another perspective view of the electric bed shown in FIG. 2 in an opposite direction.

FIGS. 1 to 4 show an electric bed according to an embodiment of the present application. The electric bed includes a base bed frame 1, a head combination bed frame supporting beam 6, a head combination bed frame 7, a head transmission mechanism 8, a head drive motor 9, a leg combination bed frame 2, a leg transmission mechanism supporting beam 3, a leg transmission mechanism 4, and a leg drive motor 5.

The base bed frame 1 includes a pair of longitudinal rims 11 extending along a y-axis and a pair of transverse rims 12 extending along an x-axis. The pair of longitudinal rims 11 and the pair of transverse rims 12 are connected to each other in an end-to-end manner and form a rectangular frame. Preferably, the pair of longitudinal rims 11 and the pair of transverse rims 12 can be connected by corner connection elements 15 to form a rectangular frame. Each of the corner connection elements 15 at least includes a first portion for connecting the longitudinal rim, a second portion for connecting the transverse rim, and an arc portion between the first portion and the second portion. The arc portion facilitates an arc transition connection between the longitudinal rim 11 and the transverse rim 12.

In the rectangular frame formed by the base bed frame 1, a central supporting platform 13 is further provided. The central supporting platform 13 is disposed in a middle of the base bed frame 1, and extends between the pair of longitudinal rims 11 of the base bed frame 1 in a direction parallel to the transverse rims 12 for supporting a mattress to be placed on the base bed frame 1.

The base bed frame 1 is divided by the central supporting platform 13 into a head drive area 101, a central support area 102, and a leg drive area 103.

In the head drive area 101 of the base bed frame 1, the head combination bed frame supporting beam 6 is further provided. The head combination bed frame supporting beam 6 extends between the pair of longitudinal rims 11 of the base bed frame 1, and is close to the central supporting platform 13. The head drive area 101 is further provided therein with a pair of reinforced supporting elements, referred to as head reinforced supporting elements 61, extending between the head combination bed frame supporting beam 6 and the transverse rim 12 near the head combination bed frame supporting beam 6.

The central supporting platform 13 constitutes the central support area 102 of the base bed frame 1.

The leg drive area 103 of the base bed frame 1 is further provided therein with the leg transmission mechanism supporting beam 3. The leg transmission mechanism supporting beam 3 extends between the pair of longitudinal rims 11 of the base bed frame 1, and is close to the central supporting platform 13. The leg drive area 103 is further provided therein with a pair of reinforced supporting elements, referred to as leg reinforce supporting elements 31, extending between the leg transmission mechanism supporting beam 3 and the transverse rim 12 near the leg transmission mechanism supporting beam 3.

The head combination bed frame 7 is hinged to the head combination bed frame supporting beam 6. The head combination bed frame 7 is capable of pivoting relative to the head combination bed frame supporting beam 6, and when the head combination bed frame 7 pivots to a horizontal position, the head combination bed frame 7 is exactly supported on the transverse rim 12 near the head combination bed frame supporting beam 6.

The head combination bed frame 7 is driven to pivot by the head transmission mechanism 8 and the head drive motor 9.

The head transmission mechanism 8 includes a pivoting part 81 hinged to the head combination bed frame supporting beam 6, a supporting part 82 resting on the head combination bed frame 7, and a lug 83 for receiving a driving force so as to enable the head transmission mechanism 8 to pivot.

More specifically, the head transmission mechanism 8 has a main body 80, and a pair of bent arms 89 symmetrically disposed are rigidly connected to two ends of the main body 80. One end of the bent arm 89 is hinged to the head combination bed frame supporting beam 6, and is referred to as a pivoting part 81; and the other end of the bent arm 89 rests on the head combination bed frame 7, and is referred to as a supporting part 82. The head combination bed frame 7 is provided thereon with a guide rail 71 for guiding the supporting part of the head transmission mechanism. A wheel 88 is further disposed on the supporting part 82, and the wheel 88 may roll on the head combination bed frame 7 along the guide rail 71 of the head combination bed frame 7. An auxiliary wheel 87 is disposed at a position on the bent arm 89 near the end of the main body 80 to facilitate rolling of the wheel 88 of the auxiliary supporting portion 82 rolls. In addition, a protruding lug 83 is disposed at a central position of the main body 80 for hinging to the head drive motor 9.

One end of the head drive motor 9 is hinged to the transverse rim 12 near the head combination bed frame 7, and the other end thereof is hinged to the lug 83 of the head transmission mechanism 8 so as to provide a driving force to the head transmission mechanism 8. Preferably, the head drive motor 9 is a pushrod motor or a linear motor.

A leg combination bed frame 2 is further hinged to the central supporting platform 13, and the leg combination bed frame 2 can pivot relative to the central supporting platform 13.

The leg combination bed frame 2 is driven to pivot by the leg transmission mechanism 4 and the leg drive motor 5.

The leg transmission mechanism 4 includes a first end 41 hinged to the leg combination bed frame 2, a second end 42 for receiving a driving force so as to enable the leg transmission mechanism 4 to pivot, and a pivoting arm 43 disposed between the first end 41 and the second end 42 and hinged to the leg transmission mechanism supporting beam 3.

More specifically, the leg transmission mechanism 4 has a base body 40, and two hinge parts extend from two ends of the base body 40. The hinge part hinging to the leg combination bed frame 2 is referred to as the first end 41, and the hinge part hinging to the leg drive motor 5 referred to as the second end 42.

One end of the leg drive motor 5 is hinged to the transverse rim 12 near the leg transmission mechanism supporting beam 3, and the other end thereof is hinged to the second end 42 of the leg transmission mechanism 4 so as to provide a driving force to the leg transmission mechanism 4. Preferably, the leg drive motor is a pushrod motor or a linear motor.

Further, a vibration absorption supporting element 77 is disposed on the transverse rim 12 near the head combination bed frame 7 in the base bed frame 1. When the head combination bed frame 7 is not driven by the head transmission mechanism 8, the head combination bed frame 7 is supported on the vibration absorption supporting element 77.

Further, the base bed frame is encased at a periphery thereof by an external cover 18. A height of the external cover 18 is larger than a thickness of the leg drive motor 5, so that the leg drive motor 5 may be hidden and cannot be seen from the outside, which enables the bed to look lighter, thinner, and more aesthetically pleasing from outside.

The above embodiments serve only as examples and are not used to limit the scope of the present application. Those skilled persons in the art may expect other embodiments capable of achieving same functions based on the above embodiments and within the protection scope of the present application.

Those skilled persons in the art may master different embodiments, variations, and improvements. In particular, it shall be noted that unless apparent contradictions or incompatibility exist, the above features, variations, and/or specific embodiments of the present application may be combined with one another. All these embodiments and variations as well as improvements shall fall within the protection scope of the present application.

What is claimed is:

1. An electric bed, comprising:

a base bed frame, which comprises a rectangular frame formed by a pair of longitudinal rims and a pair of transverse rims;

a leg combination bed frame, which is hinged to the base bed frame and is capable of freely pivoting;

a leg transmission mechanism supporting beam connected between the pair of longitudinal rims and parallel to the pair of transverse rims;

a leg transmission mechanism, which comprises a first end hinged to the leg combination bed frame, a second end for receiving a driving force so as to enable the leg transmission mechanism to pivot, and a pivoting arm disposed between the first end and the second end and hinged to the leg transmission mechanism supporting beam; and a leg drive motor, one end thereof being hinged to the transverse rim near the leg transmission mechanism supporting beam, and the other end thereof being hinged to the second end of the leg transmission mechanism;

wherein the electric bed further comprises:

a head combination bed frame supporting beam connected between the pair of longitudinal rims and parallel to the pair of transverse rims and separated from the leg transmission mechanism supporting beam by a distance;

a head combination bed frame, which is hinged to the head combination bed frame supporting beam and is capable of pivoting relative to the head combination bed frame supporting beam;

a head transmission mechanism, which comprises a main body, a pair of bent arms symmetrically disposed and rigidly connected to two ends of the main body, and a lug for receiving a driving force so as to enable the head transmission mechanism to pivot, wherein each bent arm comprises a first end, as a pivoting part, hinged to the head combination bed frame supporting beam, and a second end, as a supporting part, resting on the head combination bed frame; and a head drive motor, one end thereof being hinged to the transverse rim near the head combination bed frame, and the other end thereof being hinged to the lug of the head transmission mechanism;

wherein the head combination bed frame is provided thereon with a guide rail for guiding the supporting part of the head transmission mechanism, the supporting part being provided with a wheel and being adapted to move along the guide rail of the head combination bed frame;

wherein an auxiliary wheel is disposed at a position on the bent arm near the main body to facilitate rolling of the wheel.

2. The electric bed according to claim 1, wherein the base bed frame further comprises a central supporting platform which is fixed on a middle of the base bed frame, and the leg combination bed frame is hinged to the central supporting platform and is capable of pivoting relative to the central supporting platform.

3. The electric bed according to claim 1, wherein a plurality of head reinforced supporting elements are disposed between the head combination bed frame supporting beam and the transverse rim near the head combination bed frame supporting beam.

4. The electric bed according to claim 1, wherein a plurality of leg reinforced supporting elements are disposed between the leg transmission mechanism supporting beam and the transverse rim near the leg transmission mechanism supporting beam.

5. The electric bed according to claim 4, wherein a vibration absorption supporting element is disposed on the transverse rim near the head combination bed frame in the base bed frame, and when the head combination bed frame is not driven by the head transmission mechanism, the head combination bed frame is supported on the vibration absorption supporting element.

6. The electric bed according to claim 4, wherein the base bed frame is encased at a periphery thereof by an external cover.

7. The electric bed according to claim 6, wherein a height of the external cover is larger than a thickness of the leg drive motor, so that the leg drive motor is hidden and cannot be seen from the outside.

8. The electric bed according to claim 1, wherein the head drive motor is a pushrod motor or a linear motor.

9. The electric bed according to claim 1, wherein the pair of longitudinal rims and the pair of transverse rims are connected by corner connection elements 15 to form the rectangular frame; and each of the corner connection elements comprises a first portion for connecting a longitudinal rim, a second portion for connecting a transverse rim, and an arc portion between the first portion and the second portion.

* * * * *